United States Patent [19]

Kim

[11] Patent Number: 4,997,751

[45] Date of Patent: Mar. 5, 1991

[54] SILVER HALIDE EMULSIONS HAVING IMPROVED LOW INTENSITY RECIPROCITY CHARACTERISTICS AND PROCESSES OF PREPARING THEM

[75] Inventor: Sang H. Kim, Pittsford, N.Y.

[73] Assignee: Eastman Kodak Company, Rochester, N.Y.

[21] Appl. No.: 439,122

[22] Filed: Nov. 20, 1989

Related U.S. Application Data

[63] Continuation-in-part of Ser. No. 352,323, May 12, 1989, abandoned.

[51] Int. Cl.[5] ..... G03C 1/02

[52] U.S. Cl. ..... 430/569; 430/567; 430/605

[58] Field of Search ..... 430/567, 569, 605

[56] References Cited

U.S. PATENT DOCUMENTS

| | | | |
|---|---|---|---|
| 4,147,542 | 4/1979 | Habu et al. | 96/27 |
| 4,173,483 | 11/1979 | Habu et al. | 430/575 |
| 4,288,535 | 9/1981 | Kanisawa et al. | 430/569 |
| 4,693,965 | 9/1987 | Ihama et al. | 430/569 |
| 4,746,603 | 5/1988 | Yamashita et al. | 430/605 |
| 4,897,342 | 1/1990 | Kajiwara et al. | 430/569 |
| 4,902,611 | 2/1990 | Leubner et al. | 430/605 |

FOREIGN PATENT DOCUMENTS

| | | | |
|---|---|---|---|
| 2296204 | 7/1976 | France . | |
| 61-23146 | 1/1986 | Japan | 430/567 |

OTHER PUBLICATIONS

Carroll, "Iridium Sensitization: A Literature Review", PS&E, vol. 4, No. 6, 1980.

Sakai and Baba; "Influence of Irridium Salts on the Silver Halide Emulsion (I). Effect on Reciprocity Law Failure of Emulsions", J. Soc. Sci. Phot., Japan, 31 (1), 34–40 (1968).

Zelikman et al., "Making and Coating Photographic Emulsions", The Focal Press, London & New York, 1964.

*Primary Examiner*—Paul R. Michl
*Assistant Examiner*—T. Neville
*Attorney, Agent, or Firm*—Joshua G. Levitt

[57] ABSTRACT

The low intensity reciprocity failure characteristics of a silver halide emulsion are improved, without significant reduction of high intensity speed, by incorporating iridium ion into the silver halide grains after or toward the end of the precipitation of the grains in such a way that iridium is below the surface of the grains.

11 Claims, No Drawings

SILVER HALIDE EMULSIONS HAVING IMPROVED LOW INTENSITY RECIPROCITY CHARACTERISTICS AND PROCESSES OF PREPARING THEM

This application is a continuation-in-part of U.S. Ser. No. 352,323, filed May 12, 1989, now abandoned.

FIELD OF THE INVENTION

The present invention relates to light sensitive silver halide emulsions. In particular, it relates to light sensitive silver halide emulsions containing iridium ion which have good low intensity reciprocity characteristics and to processes of preparing such emulsions.

The amount of exposure which a film receives is expressed by the equation $E=I\times T$, in which E is exposure, I is intensity of the illumination falling on the film, and T is the length of exposure. It is known that this equation does not hold for high intensity illumination for short periods of time or for low intensity illumination for long periods of time. Thus, at these two extremes of exposure the effective sensitivity of an emulsion varies with the illumination level and the exposure time. These phenomena are referred to, respectively, as high intensity reciprocity law failure and low intensity reciprocity law failure.

Iridium ion has been suggested as a suitable component for addition to silver halide emulsions since the late 1930's. A general summary of the use of iridum in the sensitization of silver halide emulsions is contained in Carroll, "Iridium Sensitization: A Literature Review," Photographic Science and Engineering, Vol. 24, No. 6, 1980.

One of the citations in this review is French Patent No. 74/42941 (Publication No. 2,296,204) which is said to report that iridium or rhodium added during precipitation of an x-ray emulsion reduces low intensity reciprocity in screen exposures.

U.S. Pat. No. 4,693,965 describes a method of manufacturing a silver halide emulsion by chemical ripening the emulsion in the presence of an iridium salt and a photographic spectral sensitizing dye. The specification, from column 5 through column 8, suggests that an iridium salt can be added at various points during the precipitation of a silver halide emulsion or after precipitation has been terminated. The working examples which illustrate the invention show addition of the iridium salt and a spectral sensitizing dye during chemical ripening.

I have found that the point during the precipitation of a silver halide emulsion at which iridium is added to the emulsion has a significant effect on the reciprocity failure characteristics of the emulsion. Iridium has been described as improving reciprocity characteristics of a silver halide emulsion, in particular low intensity reciprocity characteristics. It is my belief that what actually was happening was that the high intensity response of the emulsion was being reduced. It would be desirable to not only improve the low intensity reciprocity characteristics of the emulsion, but to accomplish this without significantly diminishing the high intensity speed of the emulsion.

In accordance with my invention, there is provided a process of preparing a silver halide photographic emulsion which comprises commencing addition of iridium ion to the emulsion in an amount of from about $1\times10^{-10}$ to $5\times10^{-6}$ moles per mole silver after one-half or more of the silver salt which forms the silver halide grains has been added, and then physically ripening the emulsion in the presence of ammonia under conditions such that there is essentially no iridium ion on the surface of the grains.

In an alternative embodiment of my invention there is provided a process of preparing a silver halide photographic emulsion which comprises commencing addition of iridium ion to the emulsion in an amount of about $1\times10^{-10}$ to $5\times10^{-6}$ moles per mole silver after one-half or more of the silver salt which forms the silver halide grains has been added and terminating iridium addition sufficiently prior to termination of silver salt addition that essentially no iridium ion remains on the surface of the grains.

Chemical and/or spectral sensitization of the emulsion, if undertaken, is performed after ripening to cover the iridium.

The resulting grains are believed to have essentially no iridium ion on their surface. The iridium is believed to be combined in the region from about $1\times10^{-7}$ cm below the surface of the grain to a distance below the surface which is about 20% of the grain radius.

In a preferred embodiment of my invention, iridium ion addition commences after 64%, most preferably 90%, of the silver salt has been added. In another preferred embodiment, iridium ion addition commences after precipitation of the emulsion grains, and then ammonia ripening is carried out so as to cover the iridium deposited on the surface of the previously formed grains.

Silver halide emulsions of the invention can be comprised of silver bromide, silver chloride, silver iodide, silver bromoiodide, silver chlorobromide or mixtures thereof. Preferably the emulsions are silver bromide with up to 20 mole percent iodide. Most preferably they are silver bromoiodide with from 1 to 9 mole percent iodide. These silver halide emulsions can include silver halide grains of any conventional shape or size including grains with epitaxial deposits of other silver halides. Specifically the emulsions can be coarse, medium or fine, cubic, octahedral or tabular grain. The silver halide emulsions can be polydisperse or monodisperse as precipitated. The grain size distribution of these emulsions can be controlled by silver halide grain separation techniques or by blending silver halide emulsions of differing grain sizes. For example, silver bromoiodide or silver bromides of different sizes of the same type and shape can be blended.

In the process of preparing a silver halide emulsion according to the invention typically a dispersing medium, preferably an aqueous gelatin or a gelatin derivative composition, is introduced into a reaction vessel designed for silver halide precipitation equipped with an efficient stirring mechanism. Typically the dispersing medium is introduced into the reaction vessel in a concentration that is at least about 10%, preferably 20 to 80%, by weight based on the total weight of the dispersing medium present in the silver halide emulsion at the conclusion of grain precipitation. The volume of dispersing medium initially present in the reaction vessel can equal or exceed the volume of the silver halide emulsion present in the reaction vessel at the conclusion of the grain precipitation. The dispersing medium introduced into the reaction vessel is preferably a dispersion of peptizer in water, particularly gelatin in water, optionally containing other ingredients, such as silver halide ripening agents. The peptizer, particularly gelatin or a gelatin derivative, is preferably initially present in a concentration of at least 10%, preferably at least 20%, of the total peptizer present at the completion of the silver bromoiodide precipitation. Additional dispersing medium can optionally be added to the reaction vessel with the silver salts and the alkali halide salts and also can be introduced through a separate inlet means, such as a separate jet. The proportion of dispersing medium can be adjusted after the completion of the salt introductions or after washing.

During precipitation silver salts, preferably silver nitrate, and halide salts are added to the reaction vessel by techniques known in the photographic silver halide emulsion making art. Typically an aqueous silver salt solution, preferably a silver nitrate solution, is introduced into the reaction vessel concurrently with the introduction of halide salts. The halide salts are typically introduced as aqueous salts solutions, preferably as aqueous solutions of one or more alkali metal, such as potassium or sodium, salts. Alkaline earth metal salts can also be useful, such as calcium and magnesium salts. The silver salt is introduced into the reaction vessel separately from the halide salt. If more than one halide is used, the salts can be added to the reaction vessel separately or as a mixture.

The concentrations and rates of silver salt, bromide salt and iodide salt introductions can take any convenient and conventional form useful for forming silver halide emulsions. The silver and halide salts are preferably introduced in concentrations within the range of 0.001 to 10 moles per liter. The rate of silver and halide salt introduction can be constant or optionally varied either by changing the rate at which the silver and halide salt are introduced or by changing the concentrations of the silver and halide salts being introduced. It is preferred to increase the rate of silver and halide salt introduction, but to maintain the rate of introduction below that at which the formation of new grain nuclei is favored to avoid renucleation.

The individual silver and halide salts can be added to the reaction vessel through surface or subsurface delivery tubes, by gravity feed or delivery apparatus for maintaining control of the rate of delivery and the pH, pBr, and/or pAg of the reaction vessel contents as is used in the art of photographic emulsion making.

The precipitation can be carried out at a temperature in the range of 5° C. to 90° C. and is preferably carried out at a temperature within the range of 25° to 80° C.

At the start of precipitation, the pH in the reaction vessel is adjusted to be in the range of pH 1 to 6.5, preferably pH 5 to 6.5. As precipitation proceeds the pH generally remains on the acid side, i.e. below about pH 7, although the pH can be increased for particular purposes, e.g. to control nucleation or grain dimensions.

Addition of the iridium salt can occur after 50%, preferably 90%, of the silver salts have been added. Iridium is added in an amount to provide from $1\times10^{-10}$ to $5\times10^{-6}$ mole iridium ion per mole silver, preferably $1\times10^{-7}$ to $3\times10^{-6}$ mole iridium ion per mole silver. The iridium can be added as a halide salt or complex, in the trivalent or tetravalent state such as iridium halides, alkali metal iridium halide, alkaline earth metal iridium halide, and alkyl- and aryl-ammonium iridium halide, e.g., iridium (IV) chloride, iridium (IV) chloride, potassium hexachloroiridate (III), potassium hexachloroiridate (IV), and ammonium hexachloroiridate (III) or (IV).

Addition can be through a separate delivery tube or by addition to one or more of the halide salt solutions. The iridium salt can be added all at once, but preferably is added at a finite rate, which can be a constant, increasing or decreasing rate. Preferably the iridium is added at a constant rate over a short period towards the end of the precipitation. During the addition of the iridium salt, silver halide precipitation can be interrupted or continued.

After termination of the precipitation and the addition of the iridium salt, the emulsion is adjusted to near neutral and is then physically ripened with ammonia to essentially cover any iridium ion on the surface with silver halide to a depth of at least $10^{-7}$ cm. This ripening is carried out at a pH in the range of 7 to 11 preferably 8.5 to 10. It will be appreciated that a small proportion of iridium ion may be present on the surface if the silver halide shell is thin. Ripening permits smaller grains to dissolve and recrystallize on existing grains. If needed, a fine Lippmann type silver halide emulsion can be added to provide addition of silver halide. Times of from 5 seconds to 240 minutes and temperatures of from 5° to 90° C. are suitable with 1 to 60 minutes and 25° to 80° C. being preferred. Ripening is facilitated by the presence of ammonia, which acts as a strong silver halide solvent. In one embodiment, ripening is performed with 1 to 200, preferably 3–30 ml, of 15N ammonium hydroxide per mole of silver. In another embodiment ripening is performed with ammonia formed in situ by reaction between an ammonium salt, such as ammonium sulfate or ammonium nitrate and a base such as sodium hydroxide. Ripening can be terminated by lowering pH to about 6.0 by addition of acids.

Vehicles, including both binders and peptizers, can be selected from those conventionally employed in photographic silver halide emulsions. Preferred peptizers are hydrophilic colloids, that can be used alone or in combination with hydrophobic materials. Useful hydrophilic materials include both naturally occurring substances, such as proteins, protein derivatives, cellulose derivatives, such as cellulose esters, gelatin, such as alkali treated gelatin or acid treated gelatin, gelatin derivatives, such as acetylated gelatin and phthalated gelatin, polysaccharides, such as dextran, gum arabic, zein, casein, pectin, collagen derivatives, agar-agar, arrowroot and albumin and other vehicles and binders known in the photographic art. Gelatin is highly preferred.

The silver halide emulsions are preferably washed to remove soluble salts. Any of the processes and compositions known in the photographic art for this purpose are useful for washing the silver halide emulsions of the invention. The soluble salts can be removed by decantation, filtration, and/or chill setting and leaching, coagulation washing, by centrifugation, and by other methods and means known in the photographic art.

The photographic silver halide can be chemically sensitized by procedures and with compounds known in the photographic art. For example, in addition to the iridium used in accordance with this invention, the silver halide can be chemically sensitized with active gelatin, or with sulfur, selenium, tellurium, gold, platinum, palladium, osmium, rhodium, rhenium, or phosphorous sensitizers or combinations of these sensitizers, such as at pAg levels within the range of 5 to 11 and at pH levels below 8 at temperatures within the range of 30° to 80° C. The silver halide can be chemically sensitized in the presence of finish, also known as chemical sensitization, modifiers, such as compounds known to suppress fog and increase speed during chemical sensitization, such a azaindenes, azapyridazines, azapyrimidines, benzothiazolium salts, and sensitizers having one or more heterocyclic nuclei. Optionally the silver halide can be reduction sensitized, such as with hydrogen, or through the use of reducing agents, such a stannous chloride, thiourea dioxide, polyamines or amineboranes.

After completion of ripening, the photographic silver halide emulsion can be spectrally sensitized and chemically sensitized by methods and with compounds known in the photographic art. The photographic silver halide emulsion can be spectrally sensitized by, for example, dyes of a variety of classes, including the polymethine dye class, including cyanines, merocyanines, complex cyanines and merocyanines, oxonols, hemioxonols, styryls, merostyryls and streptocyanines. Combinations of spectral sensitizers are also useful.

The photographic silver halide emulsion of the invention can be used in ways, in photographic element formats, and for purposes that silver halide emulsions have been used in the photographic art, such as in black and white, color negative, or color reversal products.

The photographic silver halide elements can be either single color (i.e., black and white or monochrome) or multicolor elements. In a multicolor element, a cyan dye-forming coupler is typically associated with a red-sensitive emulsion, a magenta dye-forming coupler is typically associated with a green-sensitive emulsion and a yellow dye-forming coupler is associated with a blue-sensitive emulsion. Multicolor elements typically contain dye-forming units sensitive to each of the three primary regions of the spectrum. Each unit can comprise a single emulsion layer or multiple emulsion layers. The layers of the element and the image-forming units can be arranged in various orders as known in the photographic art. Color photographic reversal materials are preferred for use of the emulsions of this invention.

The photographic element can contain added layers, such as filter layers, interlayers, overcoat layers, subbing layers and other layers known in the art.

In the following discussion of illustrative materials that are useful in elements of the invention reference will be made to *Research Disclosure*, Dec. 1978, Item 17643, published by Kenneth Mason Publications Ltd., Dudley Annex, 21a North Street, Emsworth, Hampshire P010 7DQ, England, the disclosures of which are incorporated by reference. The publication will be identified hereafter by the term "Research Disclosure".

Any coupler or combination of couplers known in the photographic art can be used with the silver halide emulsions as described. Examples of useful couplers are described in, for example, Research Disclosure Section VII, paragraphs D,E,F and G and in U.S. Pat. No. 4,433,048 and the publications cited therein. The couplers can be incorporated as described in Research Disclosure Section VII and the publications cited therein.

The photographic emulsions and elements can contain addenda known to be useful in the photographic art. The photographic emulsions and elements can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports, such as film and paper base, as described in Research Disclosure Section XVII and the references described therein.

The photographic elements can be exposed to actinic radiation, typically in the visible region of the spectrum, to form a latent image as described in Research Disclosure Section XVIII and then processed to form a visible image using processes and compositions known in the art, such as described in Research Disclosure Section XIX and U.S. Pat. No. 4,433,048 and the references described therein.

Processing of a color photographic element as described to form a visible dye image includes the step of contacting the element with a color photographic silver halide developing agent to reduce developable silver halide and oxidize the color developing agent. Oxidized color developing agent in turn reacts with at least one coupler to yield a dye.

Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethyl-aniline hydrochloride and 4-amino-N-ethyl-N-(2-methoxyethyl)-m-toluidine di-p-toluene sulfonic acid.

With negative working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. The silver halide emulsions of this invention are preferably employed in photographic elements designed to be reversal processed to form a positive image.

The following examples further illustrate this invention:

EXAMPLE 1—IRIDIUM PLACEMENT

Emulsion Make Conditions

Emulsion A AgBrI (96.6:3.4) Control

To a precipitation vessel was added 11.0 liters of a distilled water solution that was 0.796 molar potassium bromide, $2.48\times10^{-2}$ molar potassium iodide, and contained 2.15 percent phthalated gelatin. The solution was stirred and the pH was measured 5.66 at 40° C. The temperature was increased to 56° C. and a pBr of approximately 0.10 was recorded.

A 2.56 molar silver nitrate solution was added through a single jet at a constant flow rate for 2.85 minutes with 2.33 moles of silver added. Concurrently another 2.56 molar silver nitrate solution was added through a second jet at a decreasing flow rate of 0.8× from start to finish with 2.10 moles of silver added. Addition through the first jet was halted. The addition of the 2.56 molar silver nitrate solution through the second jet was continued for 9.15 minutes at a decreasing flow rate of 0.195× from start to finish with 3.58 moles of silver added. The pBr at the end of the precipitation was recorded at ~1.4 at 56° C. The silver nitrate solutions contained 0.027 mg/Ag mole $HgCl_2$.

The emulsion was cooled to 52° C. Then 104 ml of an aqueous solution containing 52.7 g of ammonium sulfate was added. After 1 minute 208 ml of a 15.0 Normal ammonium hydroxide solution was added, and the emulsion was stirred for 5 minutes. Then pH was adjusted to 6.0 at 30° C. The emulsion was washed three times by the coagulation process as described in Yutzy and Russell U.S. Pat. No. 2,614,929.

Emulsion B AgBrI (96.6:3.4) Iridium Added at 0% Run

Emulsion B was prepared the same as Emulsion A with the exception that $0.19\times10^{-6}$ moles/Ag mole $K_3IrCl_6$ (potassium hexachloroiridate (III)) was added at 10 seconds (about 0% of silver precipitated) into the run.

Emulsion C AgBrI (96.6:3.4) Iridium Added at 64% Run

Emulsion C was prepared the same as Emulsion B with the exception that the iridium salt was added at 4.0 minutes (64% of silver precipitated) into the run.

Emulsion D AgBrI (96.6:3.4) Iridium Added at 100% Run

Emulsion D was prepared the same as Emulsion B with the exception that the iridium salt was added after the silver precipitation and at 52° C. before ammonia digestion.

Grain characterization for all emulsions was that of thick tabular grains plus a small proportion of irregular shaped three-dimensional grain population. Grain sizes are determined to be about 0.5 μm.

| Emulsion | Equivalent Circular Diameter |
|---|---|
| A | 0.52 μm |
| B | 0.43 μm |
| C | 0.52 μm |
| D | 0.49 μm |

Emulsion Evaluation

Emulsions A, B, C, and D were chemically sensitized in a time of finish series. The optimum times of the finish were 5 minutes except for the Emulsion D being finished for 10 minutes at 70° C. Each emulsion was chemically sensitized with 87.4 mg sodium thiocyanate, 5.5 mg sodium thiosulfate pentahydrate, 1.57 mg potassium tetrachloroaurate, and 22 mg 3-methylbenzothiazolium iodide for 1 silver mole. The chemically sensitized emulsions were optically dyed with 44 mg/silver mole of (5-(3-ethyl-2-(3H)-benzoxazolylidene)-3-phenylrhodanine.

The sensitized emulsions were separately coated on cellulose triacetate support at 0.80 g/m² silver and 2.13 g/m² gelatin. The coating elements contained 1.6 g/m² cyan coupler 5-[α-(2,4-di-tert-amylphenoxy)-hexanamido]-2-heptafluorobutyramidophenol and 1.7 g/Ag mole 4-hydroxy-6-methyl-1,3,3a-7-tetraazaindene, sodium salt. The coatings were overcoated with 0.89 g/m² gelatin and hardened with 4.6% bis(vinylsulfonyl)methane by weight based on total gelatin content.

The emulsion coatings were exposed through a 0 to 3.0 density step tablet (0.15 density steps) and a Wratten 2B filter to a 600 W 3200° K. tungsten light source at four different conditions and then processed to form positive images for five minutes in a color developer of the type described in the *British Journal of Photography Annual*, 1982, pages 201 to 203. Exposure conditions were for 100 second with 4.0 neutral density filter, 10 second with a 3.0 neutral density filter, 1 second with a 2.0 neutral density filter, 0.1 second with a 1.0 neutral density filter, and 0.01 second without any neutral density filter. The neutral density filters were alloy-coated Inconel® filters. (Inconel is a trade name of International Nickel Co.) The relative speed values were determined at 0.3 density units below $D_{max}$.

TABLE 1

| | Threshold Speeds at Various Exposure Times | | | | | |
|---|---|---|---|---|---|---|
| | | Threshold Speeds | | | | |
| Emulsion | $0.19\times10^{-6}$ mole $K_3IrCl_6$ at | 0.01 Sec. | 0.1 Sec. | 1 Sec. | 10 Sec. | 100 Sec. |
| A | No Ir (control) | 176 | 176 | 158 | 143 | 113 |
| B | 0% run | 149 | 160 | 154 | 156 | 137 |
| C | 64% run | 156 | 165 | 162 | 162 | 137 |
| D | 100% run | 162 | 169 | 168 | 169 | 151 |

This data indicates that by adding iridium after 50% of the run, high intensity speed loss was minimized and an improvement was obtained in low intensity reciprocity characteristics.

EXAMPLE 2—EFFECT OF AMMONIA DIGESTION

Emulsion E (Control) AgBrI (95.2:4.8) No NH4OH added

To a precipitation vessel was added 8.539 l of a distilled water solution that was 6.94 molar sodium bromide, 0.479 molar potassium iodide, and contained 2.76 percent bone gelatin. The solution was stirred and the pH was measured 5.42 at 40° C. The temperature was increased to 41° C.

A 2.5 molar silver nitrate solution containing 0.027 mg/Ag mole $HgCl_2$ was added through a jet at a constant flow rate for 27.77 minutes with 10.0 moles of silver added. At 16.67 minutes into the silver run, a 3 molar NaBr solution was added through a second jet with the following follow rates for total 8.33 minutes; for 2.77 minutes with a decreasing flow rate of 0.95× with 0.319 moles of sodium bromide solution, for 2.78 minutes with an increasing flow rate of 1.18× with 0.339 moles of sodium bromide solution, and for 2.78 minutes with an increasing flow rate of 1.08× with 0.381 moles of sodium bromide solution. At the end of the silver run, 16.68 grams ammonium sulfate dissolved in 100 ml of distilled water was added. Then $0.269\times10^{-6}$ moles/Ag mole $K_2IrCl_6$ (potassium hexachloroiridate (IV)) was added into the vessel. The emulsion was stirred for 5 minutes. The emulsion was washed after adjusting pH to 6.0 at 40° C.

Emulsion F (Invention) AgBrI (95.2:4.8) 6.5 cc/Ag mole 15N $NH_4OH$

Emulsion F was prepared the same as Emulsion E with the exception that 6.5 ml/Ag mole of a 15N ammonium hydroxide solution was added after the $K_2IrCl_6$ addition, and then pH was adjusted to 6.0 at 40 C.

Emulsions E and F are similar to emulsions A, B, C, and D in grain morphologies, and their grain sizes are about 0.25 μm.

Emulsions E and F were optimally chemically sensitized at temperatures of 70° C. and 67.2° C. for 10 minutes, respectively. These conditions also provided equal fog conditions. Each emulsion was chemically sensitized with 86 mg sodium thiocyanate, 16 mg sodium thiosulfate pentahydrate, 5.8 mg potassium tetrachloroaurate, and 27.1 mg 3-methylbenzothiazolium iodide for 1 silver mole. The chemically sensitized emulsions were optically sensitized with 572 mg/mole silver of sensitizing Dye. A, below and 193 mg/mole silver of Dye B, below.

Dye A

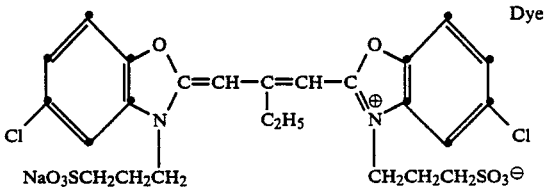

Dye B

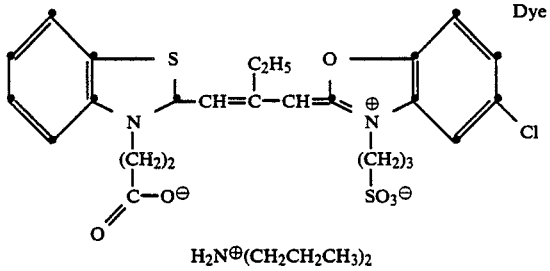

The sensitized emulsions were separately coated and evaluated as described in the above Example 1 except for the following: the coating elements contained 200 mg potassium iodide, 0.2 g 4-hydroxy-6-methyl-1,3,3a-7-tetraazaindene, sodium salt, and 22.7 mg 3,3'-decamethylene-bis(benzo-1,3-thiazolium bromide) for one silver mole and 1.6 g/m$^2$ magenta coupler

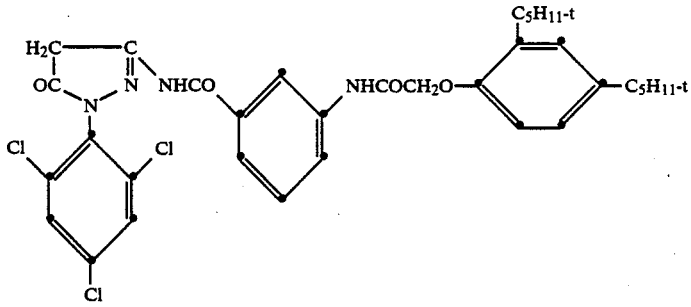

The emulsion coatings were exposed with a Wratten 9 filter and then processed for four minutes. The exposure conditions were for one second with a 2.0 neutral density filter and 100 second with two 2.0 neutral density filters. The results are shown in Table 2, below.

TABLE 2

| | | Threshold Speeds | | | | |
|---|---|---|---|---|---|---|
| Emulsion | 15N $NH_4OH$ | Fog | 1 Sec. | 100 Sec. | LIRF (1 v 100 Sec.) | % Ir found |
| E (ctrl.) | None | 0.05 | 172 | 158 | −14 | 41% |
| F (inv.) | 6.5 cc | 0.05 | 179 | 171 | −8 | 37% |

The improved LIRF was evident by the invention, and the speed increase at 1 sec. was due to the ammonia digestion. Iridium found from analysis of emulsions suggested that the iridium in the control are not efficient as those in the digested emulsion because they are not covered.

EXAMPLE 3—EFFECT OF AMMONIA LEVEL

Emulsion G AgBrI (98:2.0) 6.5 cc/Ag mole 15N $NH_4OH$

To a precipitation vessel was added 6.72 l of a distilled water solution that was 546.4 g sodium bromide, 26.72 g potassium iodide, and contained 248 g bone gelatin. The solution was stirred and pH was measured at 5.77 at 40° C. The temperature was increased to 79° C. A 1.5 molar silver nitrate solution containing 0.027 mg/mole $HgCl_2$ was added through a jet at a constant flow for 41 minutes with 8 moles of silver added. A 3 molar sodium bromide solution was added through a second jet with the following flow rates for a total of 41 minutes; 0.0705 moles for 2.5 minutes, 0.51 moles for 10 minutes with increasing flow rate of 1.52×, 0.395 moles for 5 minutes with increasing flow rate of 0.68×, 0.42 moles for 5 minutes, 0.4283 moles for 5 minutes with increasing flow rate of 0.22×, 0.463 moles for 5 minutes with increasing flow rate of 0.7×, and 0.6936 moles for 8.5 minutes with decreasing flow rate of −1.271×. The addition of 15N $NH_4OH$ and iridium ion was done the same as Emulsion F with the exception that $6.62\times10^{-7}$ moles/Ag mole $K_2IrCl_6$ (potassium hexachloroiridate (IV)) and $NH_4OH$ were added at 52° C.

Emulsion H (Invention AgBrI (98:2.0) 13 cc Ag mole 15N $NH_4OH$

Emulsion H was prepared the same as Emulsion G with the exception that the amount of both ammonium sulfate and 15N ammonium hydroxide solution were doubled.

Grain sizes of Emulsions G and H are about 1.6 μm, and analysis indicated that more iridium was incorporated by increasing ammonia concentration.

TABLE 3

| Emulsion | 15N $NH_4OH$ | Nominal Iridium, mg/g | Analyzed Iridium, mg/g | % Incorporation |
|---|---|---|---|---|
| G | 6.5 cc | 672 | 178 | 26% |
| H | 13.0 cc | 672 | 284 | 42% |

Emulsions G and H were chemically sensitized like Examples 1 and 2 except that 87.4 mg NaCNS, 2.1 mg sodium thiosulfate pentahydrate, 0.874 mg potassium chloroaurate, 11.2 mg 3-methylbenzothiazolium iodide and 2.75 g KCl were employed with heat digestion at 68° C. for 20 minutes. The chemically sensitized emulsions were optically sensitized with 180 mg/Ag mole of the sensitizing dye

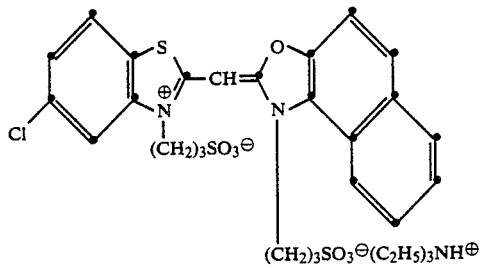

and evaluated as described in Example 1 except that there was employed 1.28 g/m$^2$ silver, 3.73 g/m$^2$ of the yellow coupler

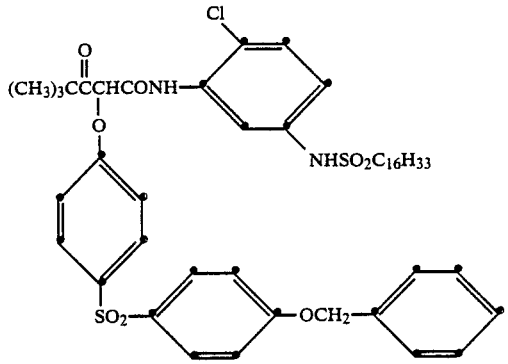

and 3.2 g/m$^2$ gelatin. The emulsion coatings were exposed like Example 2 except that a Wratten 2B filter was used instead of a Wratten 9. The coatings were developed to form a negative black and white image for five minutes followed by forming a negative color image as in Example 1. The results are shown in Table 4, below.

TABLE 4

| Emulsion | 15N $NH_4OH$ | Threshold Speeds Fog | 1 Sec. | 100 Sec. | LIRF (1 v 100 Sec.) |
|---|---|---|---|---|---|
| G (Control) | 6.5 cc | 0.45 | 248 | 228 | −20 |
| H (Invention) | 13.0 cc | 0.53 | 245 | 232 | −13 |

The improved LIRF was due to increased level of ammonium hydroxide, which helped more iridium be incorporated.

EXAMPLE 4—EFFECT OF AMMONIA DELIVERY

Emulsion I AgBrI (98:2.0) 15N $NH_4OH$

Emulsion I was made in the same way as Emulsion G with the exception that the temperature during precipitation was 68° C., the amount of $K_2IrCl_6$ added was $4.14\times10^{-7}$ moles/Ag mole, and one half the amount of ammonium sulfate and 15N NH4OH were used.

Emulsion J AgBrI(98:2.0) 2.5N NaOH

Emulsion J was made the same as Emulsion I with the exception that instead of using 15N $NH_4OH$ 4.91 times more ammonium sulfate was added and 2.5N NaOH was used to generate ammonia in situ. The pH after the NaOH addition was 9.1, as it was in Emulsion I after the $NH_4OH$ addition.

Emulsions I and J are similar to Emulsions G and H in grain morphologies, and their grain sizes are about 1.3 micometers. They are chemically sensitized like in Example 3 without KCl. Heat digestion was done for 10 and 25 min at 65° C. for Emulsions I and J, respectively. Optical sensitization was done with 180 mg/Ag mole of the sensitizing dye

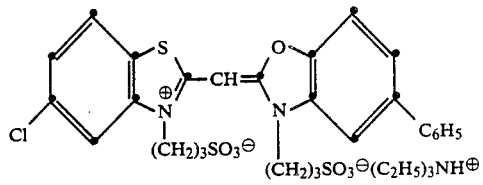

The emulsions were evaluated as in Examples 1 and 3 and the results are shown in Table 5.

TABLE 5

| | Threshold Speeds Fog | 1 Sec. | 100 Sec. | LIRF (1 v 100 Sec.) | % Iridium found |
|---|---|---|---|---|---|
| Emulsion I($NH_4OH$) | 0.33 | 229 | 206 | −23 | 38% |
| Emulsion J(NaOH) | 0.39 | 225 | 214 | −11 | 57% |

This illustrates that in-situ generation of ammonia was more efficient than addition of ammonium hydroxide because of higher iridium incorporation and improved LIRF.

The invention has been described in detail with particular reference to preferred embodiments thereof, but it will be understood that variations and modifications can be effected within the spirit and scope of the invention.

What is claimed is:

1. A process for preparing a silver halide photographic emulsion which comprises commencing addition of iridium ion to the emulsion in an amount of from about $1\times10^{-10}$ to $5\times10^{-6}$ moles per mole silver after one-half or more of the silver salt which forms the silver halide grains has been added and then physically ripening the emulsion in the presence of ammonia under conditions such that essentially no iridium ion remains on the surface of the grains.

2. A process of claim 1 wherein iridium ion addition commences after 64% of the silver salt has been added.

3. A process of claim 1, wherein iridium ion addition commences 90% of the silver salt has been added.

4. A process of claim 1 wherein iridium ion addition commences after precipitation of the silver halide grains and ripening is performed under conditions that will bury iridium ion to a depth of $1\times10^{-7}$ cm below the surface of the grain.

5. A process of claim 4, wherein chemical and spectral sensitization are performed after physical ripening.

6. A process of claim 1, wherein ammonia is generated in situ by reaction between an ammonium salt and a base.

7. A process of claim 6 wherein the ammonium salt is ammonium sulfate or ammonium nitrate and the base is sodium hydroxide.

8. A process of any one of claims 1 through 5, wherein the silver halide grains are silver bromide grains containing up to 20 mole percent iodide.

9. The process of any one of claims 1 to 5 wherein the silver halide grains are silver chloride or silver chlorobromide grains.

10. The process of claim 8, wherein the iridium ion is added as a tetravalent or trivalent salt or complex.

11. The process of claim 10, wherein the iridium ion is added in an amount that will provide from $1\times10^{-7}$ to $3\times10^{-6}$ moles iridium per mole silver.

* * * * *